US007194958B2

(12) United States Patent
Brasier et al.

(10) Patent No.: US 7,194,958 B2
(45) Date of Patent: Mar. 27, 2007

(54) PRINTED CLOTH

(75) Inventors: Alan John Brasier, Stonehouse (GB); Stuart Gardiner, Yate (GB)

(73) Assignee: Milliken Industrials Limited, Stroud (GB)

( * ) Notice: Subject to any disclaimer, the term of this patent is extended or adjusted under 35 U.S.C. 154(b) by 0 days.

(21) Appl. No.: 11/440,592

(22) Filed: Sep. 18, 2006

(65) Prior Publication Data

US 2007/0006763 A1 Jan. 11, 2007

Related U.S. Application Data

(62) Division of application No. 10/495,699, filed on Sep. 24, 2004.

(51) Int. Cl.
*B41F 1/34* (2006.01)
*B41F 21/12* (2006.01)
*B41F 21/14* (2006.01)

(52) U.S. Cl. ..... 101/485; 150/154; 150/158; 473/34; 428/88; 347/105

(58) Field of Classification Search ..... 473/34; 150/154, 158
See application file for complete search history.

(56) References Cited

U.S. PATENT DOCUMENTS

| | | | | |
|---|---|---|---|---|
| 1,516,654 A | | 11/1924 | Treiber | 473/31 |
| 1,871,003 A | * | 8/1932 | Longletz et al. | 5/490 |
| 3,613,133 A | * | 10/1971 | Isola et al. | 5/502 |
| 4,063,728 A | * | 12/1977 | Zemanek | 473/13 |
| 4,875,245 A | * | 10/1989 | Isola | 5/482 |
| 5,568,666 A | | 10/1996 | Seibert | 8/149.1 |
| 5,936,027 A | | 8/1999 | Zahrobsky et al. | 524/506 |
| 6,074,720 A | * | 6/2000 | Van Stratum | 428/41.4 |
| 6,780,117 B1 | * | 8/2004 | Osborne | 473/10 |
| 6,908,656 B2 | * | 6/2005 | Daniel et al. | 428/88 |
| 2002/0172796 A1 | * | 11/2002 | Magee et al. | 428/85 |
| 2003/0091783 A1 | * | 5/2003 | Calandrino | 428/89 |
| 2003/0129353 A1 | * | 7/2003 | Abrams | 428/88 |

(Continued)

FOREIGN PATENT DOCUMENTS

| | | |
|---|---|---|
| EP | 0 624 477 | 11/1994 |

(Continued)

*Primary Examiner*—Daniel J. Colilla
*Assistant Examiner*—Marissa Ferguson-Samreth
(74) *Attorney, Agent, or Firm*—Terry T. Moyer; Cheryl J. Brickey

(57) ABSTRACT

A process is provided for printing a graphic image onto a cue sports cloth to form a cloth layout including a bed cloth and cushion cloths. The process comprises supplying the desired dimensions of the bed cloth and cushion cloths to a digital computer, accessing a digital image, and scaling and dividing the digital image to enable the image to be printed onto a cloth, with part of the image on the bed cloth and part of the image on at least one of the cushion cloths. The image is then printed onto the cloth using a digital printing apparatus and suitable inks to create a piece of printed cloth having on it a series of image portions making up the bed cloth and the cushions. When separated and fitted to the cue sports table, the bed cloth and cushion cloths co-ordinate to create a printed image having a portion of the said image on the bed cloth and a co-ordinating portion of the image on at least one cushion cloth.

11 Claims, 2 Drawing Sheets

U.S. PATENT DOCUMENTS

Figure 1:
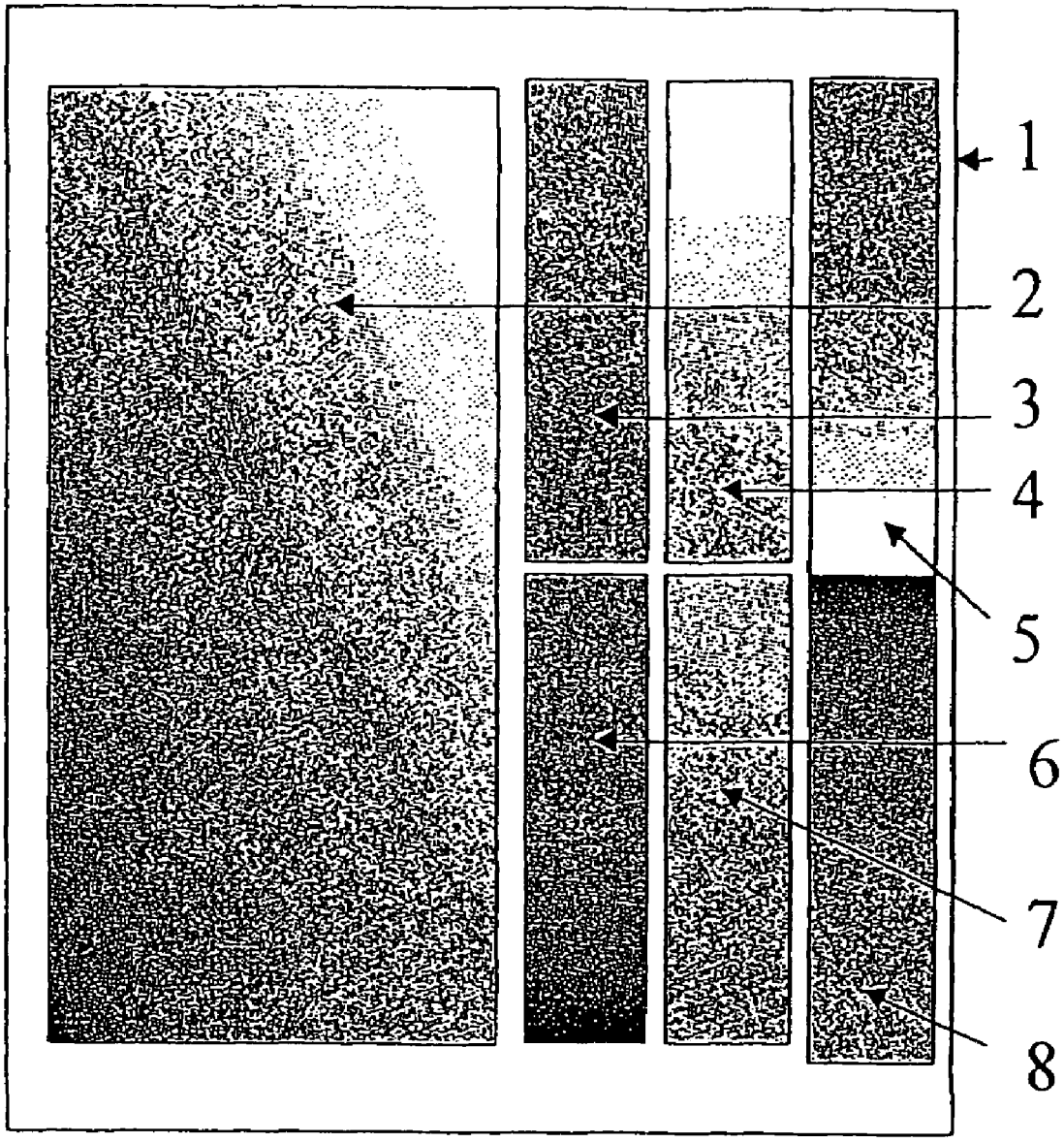

2006/0071999 A1* 4/2006 Lobley et al. ..... 347/105

FOREIGN PATENT DOCUMENTS

| | | |
|---|---|---|
| EP | 0 633 347 | 1/1995 |
| EP | 1 008 684 | 6/2000 |
| JP | 63-066386 | 3/1988 |
| WO | 97/27357 | 7/1997 |
| WO | 00/43586 | 7/2000 |

* cited by examiner

PRINTED CLOTH

CROSS REFERENCE TO RELATED APPLICATIONS

This application is a Divisional of copending U.S. patent application Ser. No. 10/495,699, filed on Sep. 24, 2004, incorporated herein.

This invention relates to the application of digital image creation and printing technology to produce custom printed woollen cloth layouts to fit cue-sports tables.

It is known to print on dyed woollen gaming table cloth using a process in which the cloth is dyed with a fugitive dye and then a print paste including a discharge agent capable of releasing the fugitive dye is silk screen printed onto the cloth, thereby removing the fugitive dye and replacing it with a new colour. Such a process is described in GB 2311079. There are several problems with the use of this process. The silk screen process is cumbersome because it necessitates the printer having to keep multiple silk screens for each layout of cloth that may be desired by a customer. It also gives a comparatively poor definition product and has limited imaging capability.

There is also known a process for printing onto polyester gaming table cloths and the like in which a design is transfer printed onto the surface of the polyester cloth from a paper substrate by means of a sublimation process, the design having been printed onto the paper by means of an inkjet printer. This type of process cannot be used for cloths made from wool or wool blends containing a major proportion of wool, and it is not therefore suitable for cue sports cloths. Polyester is unsuitable for cue sports cloths because this type of fabric does not resist soiling or cigarette burns.

It is known to use inkjet-printing technology to create printed patterns on textiles, for example for textile sample manufacture.

There is an unmet need for "mass customisation" of cue sports tables by provision of printed cloth for the bed and cushions of the table. In particular it would be desirable if a solution could be found to the problem of having to provide the bed cloth with a border of plain coloured cloth to match plain coloured cushion cloths when an image is printed onto the bed cloth for a cue sports table. Previous printing methods have not provided a satisfactory way of printing a matching pattern on the base cloth and the cushion cloths, for example because of the difficulty of aligning the different portions of the pattern when attaching the cloth to the base and the cushions.

According to the present invention there is provided a process for printing a graphic image onto a cue sports cloth to form a cloth layout including a bed cloth and cushion cloths, the process comprising the steps of:

a) supplying the desired dimensions of the bed cloth and cushion cloths to a digital computer, b) accessing a digital image, c) scaling and dividing the digital image to enable the image to be printed onto a cloth, with part of the image on the bed cloth and part of the image on at least one of the cushion cloths; and d) printing onto the cloth using a digital printing apparatus and suitable inks to create a piece of printed cloth having on it a series of image portions making up the bed cloth and the cushions, such that when separated and fitted to the cue sports table the bed cloth and cushion cloths will co-ordinate to create a printed image having a portion of the said image on the bed cloth and a coordinating portion of the image on at least one cushion cloth.

Advantageously the process is used for printing a cue sports cloth layout including a bed cloth and cushion cloths, the cue sports cloth comprising a major part by weight of wool, the process comprising the steps of:

a) Supplying the desired dimensions of the bed cloth and cushion cloths to a computer, b) receiving a digital image into a storage means at a resolution that is a factor of the size of the image and the size of the desired bed cloth, c) modifying the digital image to enable the image to be printed onto a woollen cloth at a chosen scale and position(s) to minimise the waste area of the woollen cloth within the printed layout; and d) printing onto the woollen cloth using a digital printing apparatus and suitable inks to create a piece of printed woollen cloth having on it an array of printed images comprising the printed layout including the bed cloth and cushion cloth elements such that when separated and fitted to a cue sports table the separate elements of bed cloth and cushion cloth will co-ordinate to create a desired printed textile design.

Advantageously, the cloth includes wool, and preferably comprises greater than 50% wool, most preferably greater than 70% wool.

Preferably the process prints out an image onto the cloth with a resolution of about 180 dpi or more. A preferred resolution is about 360 dpi or more or even about 720 dpi or more. In general the finer the cloth the higher the preferred resolution within the range. The original image resolution is chosen to give the desired level of resolution when scaling has been performed. The inks used for the printing step may contain a pigment or a reactive dye or an acid dye or any other colouring system, which, with suitable processing, is substantive to the cloth. The printed cloth is advantageously used for cue-sports tables. Advantageously the printing is carried out using a computer controlled digital printer. This process gives the option to alter designs frequently in a cost-effective manner.

The cloth is preferably, but not necessarily, felted and is usually selected from woollen woven felt; woollen non-woven felt and lightly felted worsted cloth. Preferably it is woven as this gives a hard wearing high quality surface which is particularly good for printing onto as it does not deteriorate as much as needlefelt during use. Preferably the woollen cloth on which the image is printed is unpatterned or undyed cloth; however, it is possible to use this process to print onto cloth which has already been dyed or printed using other techniques.

When inks containing dyestuffs are used the cloth is preferably steamed after printing to react the dyestuff to the fibres of the cloth and then washed to flush out excess unreacted dyestuff. This gives a good dye substantivity, which in turn gives the required high degree of cleanability and durability to the product.

Optionally the cloth can have a finish applied to it after printing.

In addition to scaling, the scanned digital image may also be digitally modified to make it more suitable for printing using the particular combination of ink and print technology selected to be suitable for the process. The person skilled in the art will recognise that many such modification algorithms are known in the digital printing art and these may be selected for any particular set of inks and substrate by one skilled in the art.

Preferably, the printed image has a portion of the image on the bed cloth and a co-ordinating portion of the image on all the cushion cloths.

Advantageously, lines or markings are also printed onto the cloth, the lines or markings being so positioned that they are not visible when the cloth is cut and fitted to a table and the lines or markings serving the purpose of assisting in the process of covering of the table bed and the cushions.

According to a further aspect of the invention there is provided a woollen cue sports cloth having printed thereon a layout comprising a patterned bed cloth and cushion cloths, at least one of the cushion cloths being patterned so as to co-ordinate with the bed cloth.

Lines or markings may be printed onto the cloth to assist in the covering of the cue sports table bed and the cushions. In particular the markings may take the form of lines that assist in approximately centring the printed image on the bed cloth onto the table or in aligning the image with at least one edge of the table. The lines may also assist in ensuring pattern distortion due to differential stretching of the cloth during the filling process. The markings may also indicate the origin of the cloth and contain information about the customer and/or the location of the cue sports table to which the cloth layout is to be fitted.

Preferably, the lines or markings are so positioned that they are visible during fitting of the cloth to the bed and the cushions and are no longer visible when the cushions are refitted to the cue sports table and the table is in use for cue sport.

Correspondence markings may be applied both to the bed cloth and to the matching cushion cloths. These markings are intended to ensure that each of the six printed areas that will form the cushion cloths is fitted in the correct location on the table. The advantage of such correspondence markings is that the cushion cloths can be printed in a position which optimises use of the cloth layout area rather than in a position in the layout which suggests the final position of the cushion cloths around the cue sports table. Preferably, the markings take the form of alignment lines approximately defining the edges of the area/rectangle which will be visible when the table is in use.

In one particularly preferred embodiment the correspondence marking takes the form of a colour coded border on one side of each cushion cloth and a correspondingly coloured band on the periphery of the base cloth where that cushion cloth is to be located. The coloured markings are so arranged that they will not be visible when the cushions and base cloth are fitted. Most preferably the lines to assist the uniform stretch of the bed cloth and the coloured border areas are combined by printing coloured lines or printing lines onto solid coloured backgrounds of the appropriate colours.

According to a further aspect of the invention there is provided a pool or snooker table fitted with a bed cloth and cushion cloths made from a printed cloth layout according to any one of the preceding statements of invention.

Figure 2:
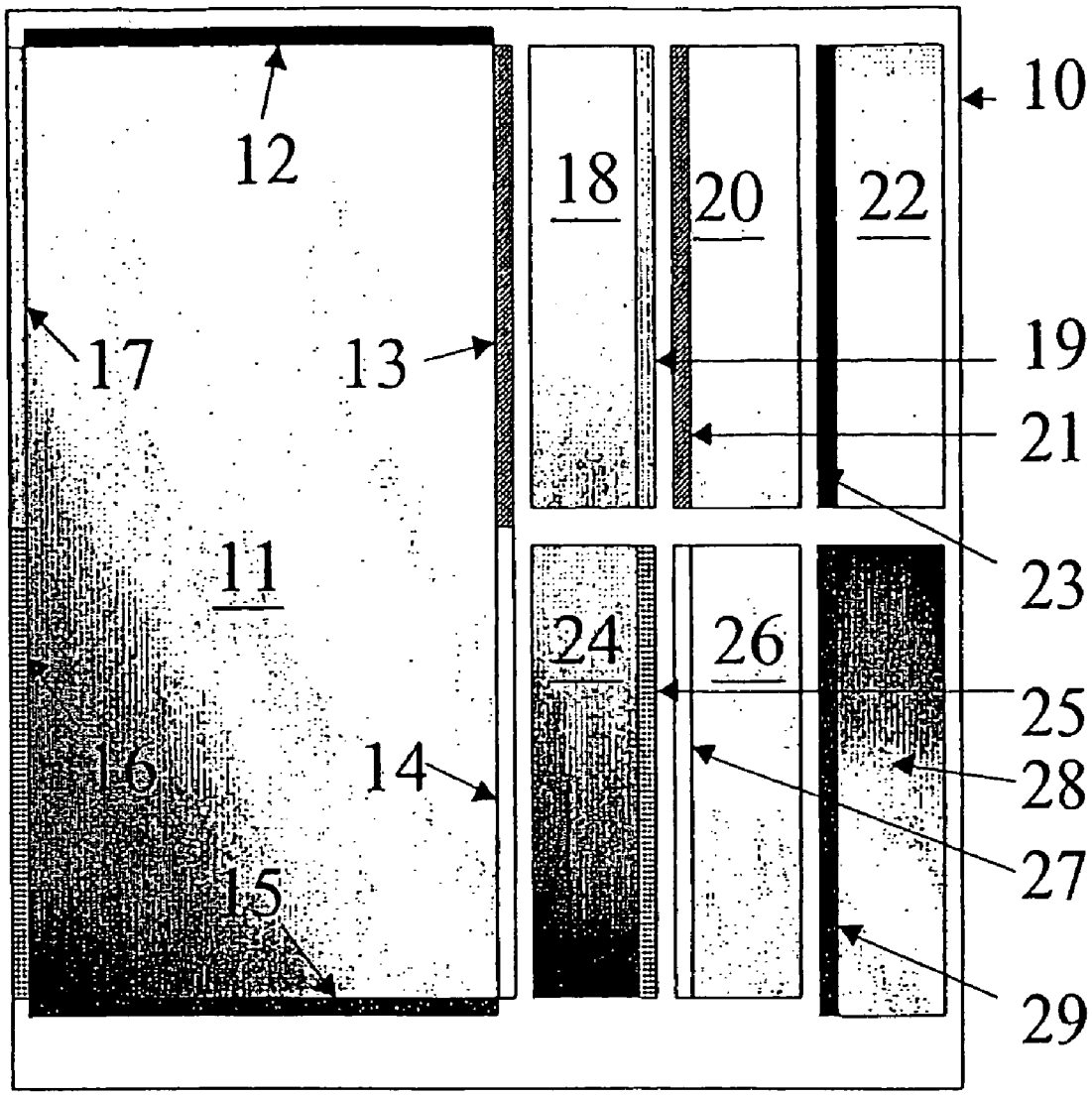

The invention will now be further described with reference to the following non-limiting illustrative examples and to the accompanying drawings of which:

FIG. 1 is a schematic plan view of a printed snooker table cloth layout on a piece of woollen cloth; and FIG. 2 is a schematic plan view of a printed pool table cloth layout with added installation markings.

EXAMPLE 1

A photographic representation of a company logo measuring 10 cm by 16 cm was scanned into a digital scanner connected to a computer loaded with image manipulating and processing software. The image processing software was then used to alter the scanned image by scaling it to fit a pool table. Because the image was still not of the correct proportions to fill a pool table bed cloth both in terms of length and width, it filled the width but not the length, the image so formed was again manipulated to superimpose it onto a blue background colour before sending the data file so created to a digital printer supplied by Mimaki. The printer had a print head using acid dyestuffs. The printer printed the manipulated image onto a piece of felted woollen woven cloth, which was not previously dyed and which had been produced using a conventional felting and finishing process. Prior to printing print fixation chemicals had been applied to the cloth by padding and the cloth had been dried. The invention contemplates alternatives to this technology whereby the entire printing ink formulation may be applied through the print head to eliminate the need to apply prepare for print chemistry. The use of inks containing pigments would allow for this. For this example the modified image was printed onto the cloth using multiple colours of acid dyes. The cloth was then subjected to a steam fixation process and then washed and dried before going forward to a conventional dry finishing process comprising cropping and brushing as appropriate for the end product.

EXAMPLE 2

A digital image was created using proprietary drawing software to produce a scene depicting dancing animals. The image file so produced was saved. Image manipulation software was then used to create images of appropriate size and resolution for the size of cloth to be printed. The data was then fed to a digital printer, which printed a piece of prepared white woollen cloth with the images, using acid dyes. The images were then fixed by steaming and washed and dried. The cloth was then suitable for use as a cue-sports table cloth.

EXAMPLE 3

A computer generated graphic image is fed to cloth layout software. The operator calls up a first template which shows the visible portions of a snooker table bed cloth having arranged around its periphery, the visible portions of the adjacent cushion cloths. Each cushion cloth being adjacent to the appropriate edge of the bed cloth. The dimensions of the actual snooker table to be fitted may then optionally be fed to the computer and the first template size is adjusted and scaled accordingly. The graphic image is then appropriately sized and positioned in superimposed fashion onto the first template, thus creating a pattern which co-ordinates across the bed cloth and the cushion cloth elements. This juxtaposition of graphic image and the first template is then transformed digitally onto a second template which represents the printed layout of the elements including border areas for each element to allow it to be fitted to the bed or cushion as required. This layout so transformed and produced on the second template is then printed onto a suitable woollen cloth using a digital printer. FIG. 1 shows the woollen cloth 1 on which printed with a graded graphic image that fades diagonally across the main rectangle of cloth 2 shaped to fit the bed of the snooker table. The six cushion pieces 3, 4, 5, 6, 7 and 8 have been appropriately shaded and positioned to maximise the use of the cloth width and to optimise the fit of the cloth to the cushions when the cloth is cut up into its seven constituent pieces and fitted to a snooker table.

Co-ordination of the image between the bed cloth and the cushion cloth can include extension of the graphic image in a continuous fashion from the bed cloth to the cushion cloth as described above. It also includes the aesthetically pleasing sizing and placement of one or more design motifs or elements found in the area comprising the bed cloth part of the layout and reproducing these modified motifs or elements on at least one of the cushion cloth areas.

EXAMPLE 4

FIG. 2 shows part of a piece of pool cloth 10 that has been printed in a similar manner to that used for example 3. To assist in the installation of the cloth additional information has been printed onto the cloth 10 in areas where it will be substantially hidden when the installation onto a pool table is complete. First the fitter needs to cut or tear the seven pieces of matched cloth making up the bed cloth 11 and the six cushion cloths 18, 20, 22, 24, 26 and 28. Each piece has one or more installation markings also printed onto it. Thus the bed cloth has in this instance six bands of differently coloured borders 12, 13, 14, 15, 16 and 17 which are hidden from view when the cushions have been re-fixed to the table. Each cushion cloth has a corresponding band of colour 19, 21, 23, 25, 27, and 29 printed next to it to show which cushion it is intended to cover and which way around that it should be fixed to ensure that the overall printed design on the bed cloth and the cushions co-ordinates in the manner intended. As an alternative to coloured bands it is possible to use numbers or symbols or any other device indicative of how the cloth should be put together to achieve the required design.

The bed cloth 11 may also be provided with printed perimeter markings which take the form of one or more lines defining one or more congruent rectangles approximately the same size as the bed on which the bed cloth is to be fixed. The fitter may use these lines during stretching of the cloth to enable the cloth to be stretched and fitted to the table in a manner that does not unduly distort the overall pattern applied to the cloth. In its simplest form the perimeter marking can be the straight-line interface between the patterned area and the edge markings 12, 13, 14, 15, 16 and 17 as shown. Alternatively, bed cloth 11 may contain index marks associated only with the pocket areas, if any, or the corner areas. Specifically such index marks may be in the form of nested straight or curved lines.

What is claimed is:

1. A process for printing a graphic image onto a cue sports cloth to form a cloth layout including a bed cloth and cushion cloths, the process comprising the steps of:

a) supplying the desired dimensions of the bed cloth and cushion cloths to a digital computer, b) accessing a digital image, c) scaling and dividing the digital image to enable the image to be printed onto a cloth, with part of the image on the bed cloth and part of the image on at least one of the cushion cloths; and d) printing onto the cloth using a digital printing apparatus and suitable inks to create a piece of printed cloth having on it a series of image portions making up the bed cloth and the cushions, such that when separated and fitted to the cue sports table the bed cloth and cushion cloths will coordinate to create a printed image having a portion of the said image on the bed cloth and a coordinating portion of the image on at least one cushion cloth.

2. The process according to claim 1, wherein the cloth comprises wool.

3. The process according to claim 2, wherein the cloth comprises greater than 50% wool.

4. The process according to claim 2, wherein the cloth comprises greater than 70% wool.

5. The process according to claim 1, wherein the inks used for the printing step are selected from the group consisting of pigments, reactive dyes, acid dyes and mixtures thereof.

6. The process according to claim 1, wherein the cloth is felted and is selected from the group consisting of woven woolen felt, non-woven woolen felt and lightly felted worsted cloth.

7. The process according to claim 1, wherein the cloth is woven.

8. The process according to claim 1, wherein the cloth is unpatterned or undyed cloth.

9. The process according to claim 1, wherein after the printing steps the cloth is subjected to the further steps of steaming and then washing.

10. The process according to claim 1, wherein the printed image has a portion of the image on the bed cloth and a coordinating portion of the image on all the cushion cloths.

11. The process according to claim 1, characterized in that lines or markings are also printed onto the cloth, the lines or markings being so positioned that they are not visible when the cloth is cut and fitted to a table and the lines or markings serving the purpose of assisting in the process of covering of the table bed and the cushions.

* * * * *

UNITED STATES PATENT AND TRADEMARK OFFICE

CERTIFICATE OF CORRECTION

PATENT NO. : 7,194,958 B2
APPLICATION NO. : 11/440592
DATED : March 27, 2007
INVENTOR(S) : Brasier et al.

It is certified that error appears in the above-identified patent and that said Letters Patent is hereby corrected as shown below:

Title Page

Delete (22) "Filed: Sep. 18, 2006"

Insert (22) --PCT Filed: Nov. 22, 2002--

Insert (86) --PCT No.: PCT/GB02/05269--

Insert (87) --PCT Pub. No.: WO 03/046274--

Insert (87) --PCT Pub. Date: Jun. 5, 2003--

Insert (30) Foriegn Application Priority Data
--Nov. 23, 2001 (GB)……...0128114.6
Nov. 23, 2001 (GB)……...0128119.5--

Signed and Sealed this

Twenty-fifth Day of December, 2007

JON W. DUDAS
*Director of the United States Patent and Trademark Office*